US011197525B2

(12) United States Patent
Benarde et al.

(10) Patent No.: US 11,197,525 B2
(45) Date of Patent: Dec. 14, 2021

(54) DRINK SPIKING PREVENTION DEVICE

(71) Applicants: Michael Benarde, West Palm Beach, FL (US); Shirah Benarde, West Palm Beach, FL (US)

(72) Inventors: Michael Benarde, West Palm Beach, FL (US); Shirah Benarde, West Palm Beach, FL (US)

(73) Assignee: Night Cap It, LLC, West Palm Beach, FL (US)

( * ) Notice: Subject to any disclaimer, the term of this patent is extended or adjusted under 35 U.S.C. 154(b) by 183 days.

(21) Appl. No.: 16/781,842

(22) Filed: Feb. 4, 2020

(65) Prior Publication Data

US 2020/0337431 A1 Oct. 29, 2020

Related U.S. Application Data

(60) Provisional application No. 62/837,515, filed on Apr. 23, 2019.

(51) Int. Cl.

| | |
|---|---|
| ***A45D 8/34*** | (2006.01) |
| ***A47G 19/22*** | (2006.01) |
| ***A45D 8/00*** | (2006.01) |
| ***B65D 41/22*** | (2006.01) |
| ***A45F 5/00*** | (2006.01) |

(52) U.S. Cl.

CPC ..... *A45D 8/34* (2013.01); *A45D 8/002* (2021.01); *A47G 19/2205* (2013.01); *B65D 41/22* (2013.01); *A45F 2005/008* (2013.01); *A47G 2400/123* (2013.01); *B65D 2401/00* (2020.05)

(58) Field of Classification Search

CPC ..... A47G 2400/123; A47G 19/2211; A47G 2400/00; A47G 2400/152; A47G 2400/126; A47G 19/2216; A45D 8/34; A45D 8/002; B65D 41/22; B65D 2401/00

USPC ..... 220/287

See application file for complete search history.

(56) References Cited

U.S. PATENT DOCUMENTS 5,413,126 A * 5/1995 Revson ..... A45D 8/34 132/275
5,758,671 A * 6/1998 Thim ..... A44C 5/0053 132/273

(Continued)

FOREIGN PATENT DOCUMENTS

AU 2013100193 A4 2/2013
CN 101461637 A 12/2007

(Continued)

*Primary Examiner* — Don M Anderson
*Assistant Examiner* — Jennifer Castriotta
(74) *Attorney, Agent, or Firm* — Polsinelli PC

(57) ABSTRACT

A drink spiking prevention device comprising a hair accessory and a cover. The hair accessory having a band forming a circle and the band being elastic. The hair accessory further having a hair accessory fabric forming a tube that encapsulates the elastic band and a pouch coupled to the hair accessory fabric. The cover is stored in and removeable from the pouch. The cover includes a cover fabric that extends to a perimeter, an aperture formed in the cover fabric, and a cord extending from the perimeter and coupled to the hair accessory. The cover covers an opening of a cup by the perimeter stretching over and conforming to a diameter of the opening to prevent new material from being added to a liquid in the cup.

20 Claims, 5 Drawing Sheets

(56) References Cited

U.S. PATENT DOCUMENTS

| | | | | |
|---|---|---|---|---|
| 6,000,408 | A * | 12/1999 | Maturaporn | A45D 8/34 132/273 |
| 6,105,837 | A * | 8/2000 | Teed | A41D 20/00 132/273 |
| 6,263,885 | B1 * | 7/2001 | Levy | A44C 5/0053 132/273 |
| 6,276,551 | B1 * | 8/2001 | Miller, II | B65D 41/22 150/154 |
| 7,735,682 | B1 * | 6/2010 | Cassel | A47K 10/38 221/185 |
| 8,453,865 | B1 | 6/2013 | Van De Klippe et al. | |
| 8,978,907 | B2 | 3/2015 | Greenberg | |
| 9,138,023 | B2 | 9/2015 | Karam | |
| 9,737,161 | B1 | 8/2017 | Li | |
| 9,782,029 | B1 * | 10/2017 | FitzSimons | B65D 51/1605 |
| 10,254,266 | B2 | 4/2019 | Abramson et al. | |
| D855,291 | S * | 8/2019 | Davis | D2/861 |
| 10,433,664 | B2 | 10/2019 | Brannock | |
| 10,582,787 | B2 | 3/2020 | Panek | |
| 2003/0082320 | A1 * | 5/2003 | Toussant | B65D 41/22 428/35.2 |
| 2006/0278252 | A1 * | 12/2006 | Miller | A42B 1/041 132/274 |
| 2010/0095977 | A1 | 4/2010 | Schmitz et al. | |
| 2012/0145727 | A1 * | 6/2012 | Gammage | A47G 19/2211 220/709 |
| 2015/0360807 | A1 | 12/2015 | Ciccotelli et al. | |
| 2016/0262558 | A1 * | 9/2016 | Beck, Jr. | A47G 19/2272 |
| 2017/0216099 | A1 | 4/2017 | Saladino | |
| 2018/0014672 | A1 | 1/2018 | Coey | |
| 2018/0177315 | A1 * | 6/2018 | Thrasher | A47G 19/2211 |
| 2019/0270557 | A1 * | 9/2019 | Smith-Phillips | A47G 23/0208 |
| 2020/0337431 | A1 | 2/2020 | Benarde et al. | |
| 2021/0093109 | A1 | 4/2021 | Green | |

FOREIGN PATENT DOCUMENTS

| | | | |
|---|---|---|---|
| GB | 2322289 | B | 10/1995 |
| WO | 2013090803 | A1 | 12/2011 |

* cited by examiner

DRINK SPIKING PREVENTION DEVICE

CROSS-REFERENCE TO RELATED APPLICATIONS

The present application claims priority under 35 U.S.C. § 119 to U.S. Provisional Application No. 62/837,515, entitled "DRINK SPIKING PREVENTION DEVICE" and filed on Apr. 23, 2019, which is incorporated by reference in its entirety herein.

FIELD

The following description relates to covers and, more specifically, to a cover wearable as a hair accessory and operable to cover an opening of a cup, thereby preventing foreign substances being added to the cup.

BACKGROUND

Drink spiking is the act of one adding alcohol or drugs to a drink without the permission of another. This can occur when drinks are served at places such as nightclubs, bars, pubs, parties, and restaurants. The act of drink spiking is usually linked to criminal activities like assault and robbery. According to the Office on Women's Health, the most used drugs include Rohypnol, GHB, and Ketamine. This is due to the fact that they're not easily detected as these drugs are odorless, colorless and tasteless. Drink spiking is usually performed at a house party, bars, clubs, and music festivals. The effects it can have include slurring of words, confusion, blacking out, inability to speak, loss of balance, body weakness, vomiting, unconsciousness and much more.

Conventional devices designed to prevent drink spiking suffer from various deficiencies. For example, U.S. Pat. No. 8,453,865 discloses a beverage container with a tamper resistant lid, which is problematic as the container is bulky and noticeable to carry. In another example, U.S. Pat. No. 8,978,907 discloses a drink cover for covering a mouth of a can or a bottle that is formed of a flexible sheet material, which is problematic as the cover must be inconveniently carried for use. In yet another example, U.S. Pat. No. 10,254,266 discloses a system and method for a beverage container configured to test for a contaminated beverage in the beverage container, which is problematic as the container is also bulky and must be carried for use.

Accordingly, there exists a need for a device that does not suffer from the aforementioned deficiencies, that is operable to fit over an opening of multiple sizes and can be discreetly worn as a hair accessory.

SUMMARY

The drink spiking prevention device creates a fashionable and functionable tool for a person to use as a prevention method for drink spiking. The device utilizes an everyday use hair accessory (e.g., a scrunchie, hair tie, or the like) by adding a component that enables a person to easily cover their drink. With the device, a person does not have to constantly watch over their drink as their hair accessory will bring them peace of mind. The hair accessory is worn around the wrist or hair as one enters a club, bar, party or anywhere beverages can be consumed. The device contains a hole in the fabric to place a straw inside the drink while still ensuring a safe experience. Along with this, the device will come in both a disposable and washable forms.

Disclosed herein is a drink spiking prevention device comprising a hair accessory. The hair accessory can have a band forming a circle. The band can be elastic. The hair accessory can have a hair accessory fabric forming a tube that encapsulates the elastic band. The hair accessory can have a pouch coupled to the hair accessory fabric. The device can have a cover stored in and removeable from the pouch. The cover can have a cover fabric that extends to a perimeter. The cover can have an aperture formed in the cover fabric. The cover can have a cord extending from the perimeter and coupled to the hair accessory. The cover can cover an opening of a cup by the perimeter stretching over and conforming to a diameter of the opening. The aperture can receive an elongate tube when the cover covers the opening of the cup.

The pouch can have a length at least one-third of a length of the tube. The pouch can have a length less than one-third of a length of the tube.

The cover fabric can be opaque, transparent, or semi-transparent. The cover fabric can detect when a new material is added to a liquid held in the cup. The cover fabric can display a visual cue when the new material is detected. The visual cue can be a stain.

The opening of the pouch can extend around the tube of the hair accessory fabric. The opening of the pouch can extend partially around the tube of the hair accessory fabric.

Also disclosed herein is a method for preventing drink spiking. The method can include removing a cover from a hair accessory. The hair accessory can comprise a band forming a circle, a hair accessory fabric forming a tube that encapsulates the elastic band, and a pouch coupled to the hair accessory fabric. The pouch can receive and store the cover. The cover can have a cover fabric that extends to a perimeter, an aperture formed in the cover fabric, and a cord extending from the perimeter and coupled to the hair accessory. The method can include stretching the perimeter and cover over an opening of a cup. The method can include releasing the perimeter and cover, the perimeter conforming to a diameter of the opening, thereby securing the cover over the opening. The method can include receiving an elongate tube by the aperture.

The foregoing is intended to be illustrative and is not meant in a limiting sense. Many features of the embodiments can be employed with or without reference to other features of any of the embodiments. Additional aspects, advantages, and/or utilities of the present disclosure will be set forth in part in the description that follows and, in part, will be apparent from the description, or can be learned by practice of the present disclosure.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present disclosure is not limited to the precise embodiments and features shown. The accompanying drawings, which are incorporated in and constitute a part of this specification, illustrate an embodiment of apparatuses consistent with the present disclosure and, together with the description, serve to explain advantages and principles consistent with the present disclosure.

DETAILED DESCRIPTION

Figure 1:
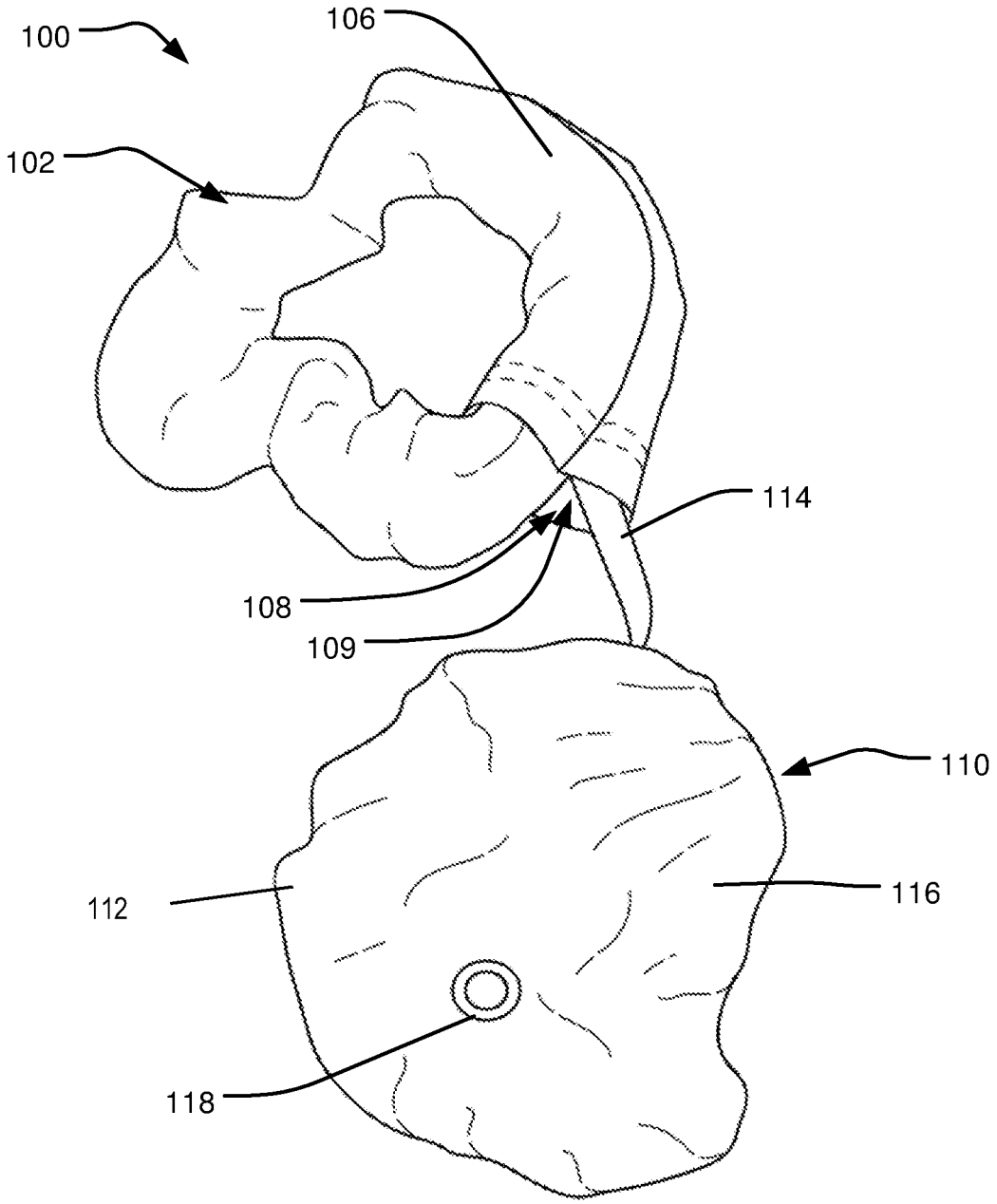
FIG. 1 is an isometric view of a drink spiking prevention device with a cover removed from a pouch of a hair accessory.

It is to be understood that the present disclosure is not limited in its application to the details of construction and to the embodiments of the components set forth in the following description or illustrated in the drawings. The figures and written description are provided to teach any person skilled in the art to make and use the presently disclosed technology. The presently disclosed technology is capable of other embodiments and of being practiced and carried out in various ways. Persons of skill in the art will appreciate that the development of an actual commercial embodiment incorporating aspects of the presently disclosed technology will require numerous implementations—specific decisions to achieve the developer's ultimate goal for the commercial embodiment. While these efforts can be complex and time-consuming, these efforts, nevertheless, would be a routine undertaking for those of skill in the art having the benefit of this disclosure.

Further, as the presently disclosed technology is susceptible to embodiments of many different forms, it is intended that the present disclosure be considered as an example of the principles of the presently disclosed technology and not intended to limit the presently disclosed technology to the specific embodiments shown and described. Any one of the features of the presently disclosed technology can be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment can also be included in other embodiments, but is not necessarily included. Thus, the presently disclosed technology can include a variety of combinations and/or integrations of the embodiments described herein. Additionally, all aspects of the present disclosure, as described herein, are not essential for its practice. Likewise, other systems, methods, features, and advantages of the presently disclosed technology will be, or become, apparent to one with skill in the art upon examination of the figures and the description. It is intended that all such additional systems, methods, features, and advantages be included within this description, be within the scope of the present inventive concept, and be encompassed by the claims.

Turning to FIG. 1, a drink spiking prevention device 100 is illustrated. The device 100 includes a hair accessory 102 (e.g., a scrunchie, hair tie, or the like) having a band (not visible) forming a circle. The band is elastic in the illustrated example, though the band can be static in other examples. The hair accessory 102 also includes a hair accessory fabric 106 forming a tube that encapsulates the band. The hair accessory fabric 106 is elastic in the illustrated example, though the hair accessory fabric 106 can be static in other examples. The hair accessory fabric 106 can be made from any material and/or texture, such as velvet, cotton, polyester, silk, batiste, or the like. The hair accessory fabric 106 can be any color and/or transparency such as opaque, transparent, or semi-transparent.

The hair accessory 102 also includes a pouch 108 coupled to the hair accessory fabric 106. The pouch 108 can receive and store the cover 110 when the cover 110 is not in use. Further, the pouch 108 discretely stores the cover 110 so that the hair accessory 102 can be worn without the cover 110 being visible. Such covert storing can prevent signaling to other people that the user has a device 100. The pouch 108 can have a pouch opening 109 that extends around the entire tube of the hair accessory fabric 106 or can extend partially around the tube. In some examples, the pouch opening 109 can extend the length of the pouch. In other examples, the pouch opening 109 may have a zipper to open and close the pouch opening 109. The pouch 108 can have a length at least one-third a length of the tube or less than one-third a length of the tube. The pouch 108 can be coupled to the hair accessory fabric 106 in any manner such as, but not limited to, by sewing, adhesion, or the like.

Figure 3:
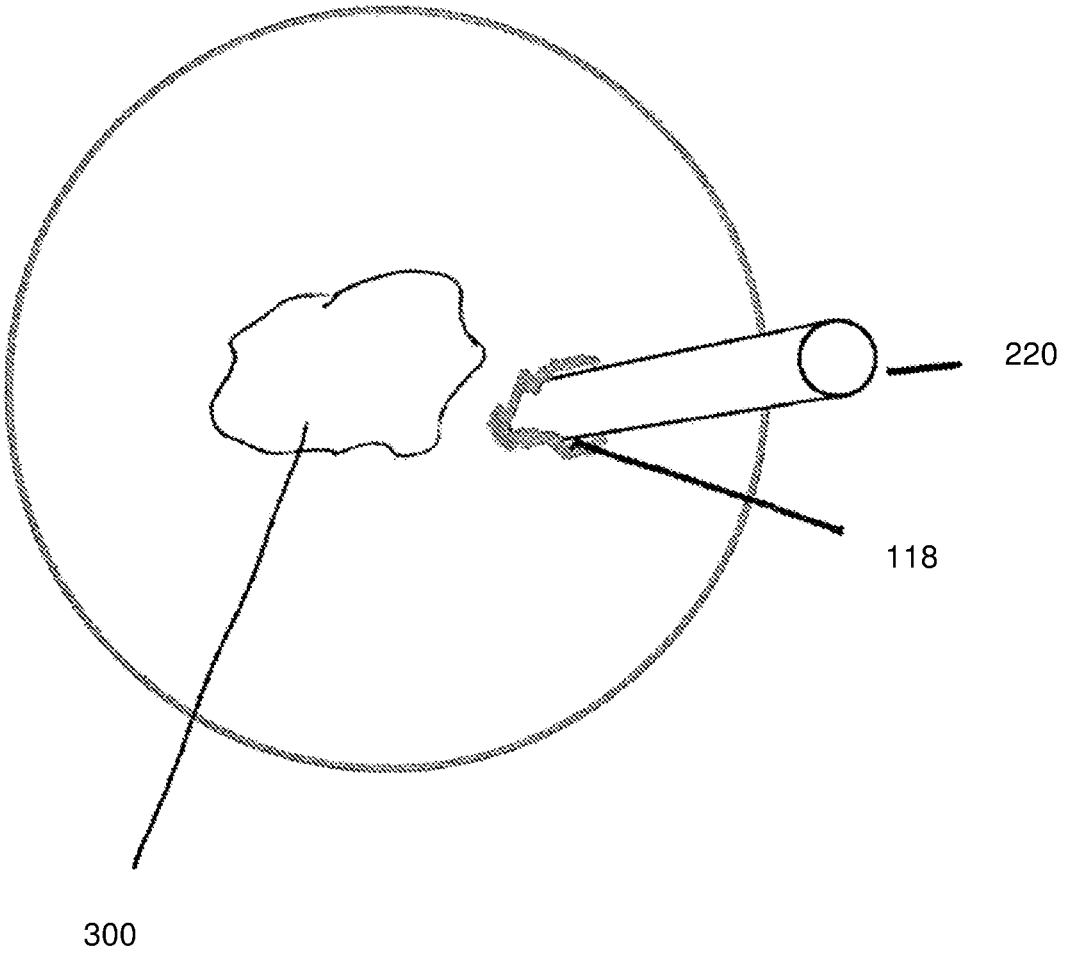
FIG. 3 is a top view of the device deployed on the cup.

The device 100 further includes a cover 110 stored in and removable from the pouch 108. The cover 110 can be reusable or can be single use. The cover 110 includes a cover fabric 112 that extends to a perimeter 116, an aperture 118 formed in the cover fabric 112, and a cord 114 extending from the perimeter 116 and coupled to the hair accessory 102. The cover fabric 112 is elastic in the illustrated example, though the cover fabric 112 can be static in other examples. The cover fabric 112 can be made from any material and/or texture, such as velvet, cotton, polyester, silk, batiste, or the like. The cover fabric 112 can also be liquid repellent. The cover fabric 112 can be any color and/or transparency such as opaque, transparent, or semi-transparent. The cover fabric 112 can further be made of a material that detects when a new material is added to a liquid held in a cup and can provide a visual indicator (e.g., a stain as shown in FIG. 3) or cue when a new material is detected.

The perimeter 116 can be elastic as illustrated, or can be static with a pull tie to tighten the perimeter 116. The perimeter 116 stretches over and conforms to a diameter of an opening of a cup when the cover is utilized to cover the opening. In some examples the perimeter 116 can be an elastic band sewn or adhered to the cover and in other examples, the perimeter can be a free edge, sewn over edge, or folded over and adhered edge of the cover fabric 112.

The aperture 118 can receive an elongate tube (e.g., a straw 220 in FIG. 2) when the cover 110 covers the opening of the cup, thereby allowing a user to drink from the cup while maintaining protection of the opening of the cup.

In the illustrated example, the cord 114 extends from the perimeter 116, though the cord 114 can extend from any part of the cover 112 without deviating from the scope of the present disclosure. In the illustrated example, the cord 114 couples or attaches to the hair accessory fabric 106 near the opening 109 of the pouch 108, though the cord 114 can couple or attach to the hair accessory fabric 106 outside of or inside of the pouch 108. The cord 114 can be adhered to, sewn to, or otherwise coupled to the cover 112 and/or the hair accessory 102. In some examples, the cord 114 may be releasably attachable to the cover 112 and/or the hair accessory 102 for replacement of the cover 110 or the hair accessory 102. For example, a user may wish to change the color of the hair accessory 102 and can attach a new hair accessory 102 to the same cover 110. In another example, the user may wish to change the cover 110 after single or multiple uses. In the illustrated example, the cord 114 is elastic, though in other examples the cord 114 can be static, flexible, or stiff. The cord 114 provides secure attachment of the cover 110 to the hair accessory 102 so that the cover 110 is not lost or misplaced from the hair accessory 102.

Figure 2:
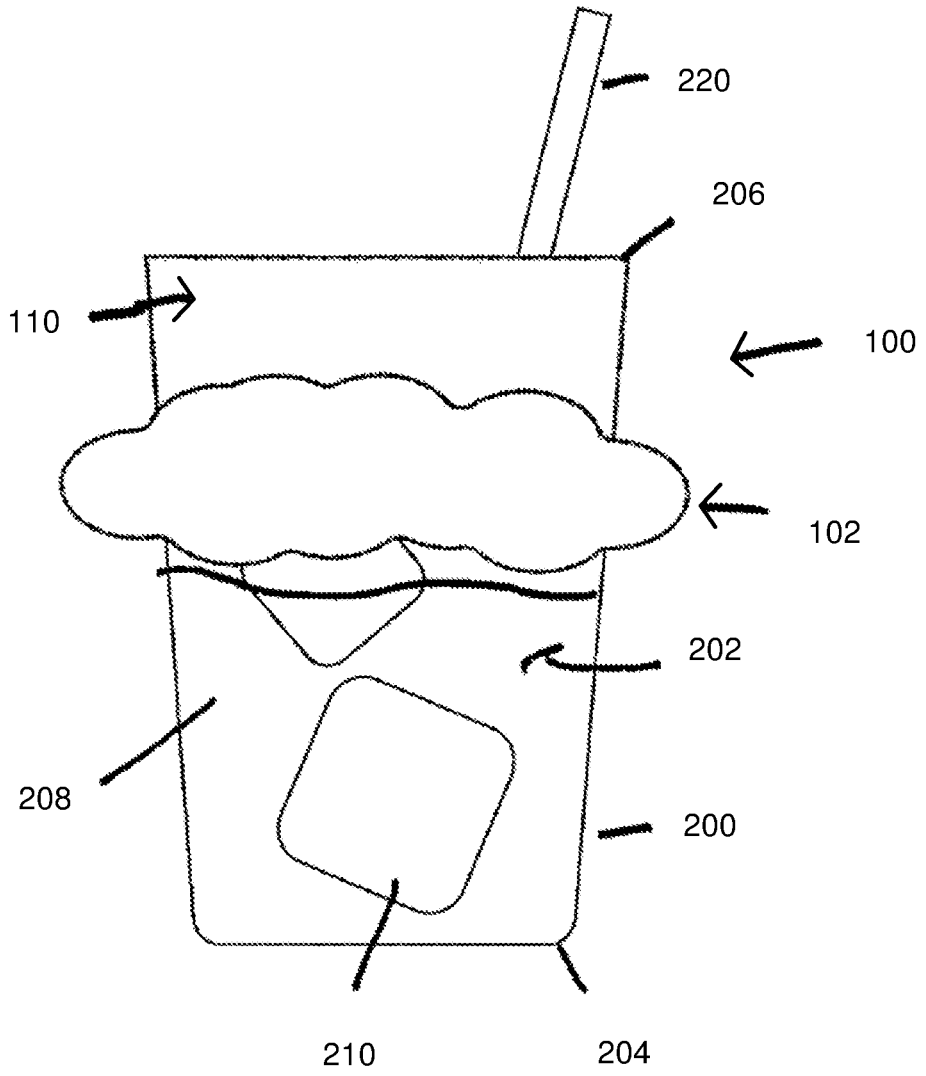
FIG. 2 is a side view of the device deployed on a cup.

Turning to FIG. 2, a conventional drinking cup 200 is shown. The cup 200 includes a continuous side wall 202 with a sealed bottom 204 and an opening 206. The cup 200 holds a user's preferred liquid beverage 208, which can be chilled using ice cubes 210. Social activities typically involve a liquid beverage that can be alcoholic or be non-alcoholic. As shown, the device 100 is in use with the cup 200. The cover 110 covers the opening 206 by stretching the perimeter 116 (not visible) and cover fabric 112 over the opening 206 and releasing the perimeter 116 to conform to the diameter of the opening 206. The perimeter 116 holds the cover 110 tightly over the opening 206. The hair accessory 102 can be further stretched over the side wall 202 for convenient securement and placement of the hair accessory 102 that is out of the way of the user. As shown, the cover 110 protects the liquid beverage 208 by covering the opening 206 and preventing a person from adding additional substances to the liquid beverage 208. The cover 110 also prevents inadvertent objects or substances (i.e., bugs, dust, etc.) from entering the cup 200.

Turning to FIG. 3, a top view of the cup 200 is shown illustrating the cover 110 covering the opening 206. As previously described, the aperture 118 allows for use of a straw 220 for the user to drink from the cup while maintaining protection of the opening 206. Also as previously described, a fluid stain 300 is shown and illustrates a visual indicator or cue that the liquid beverage 208 has been tampered with.

Figure 4A:
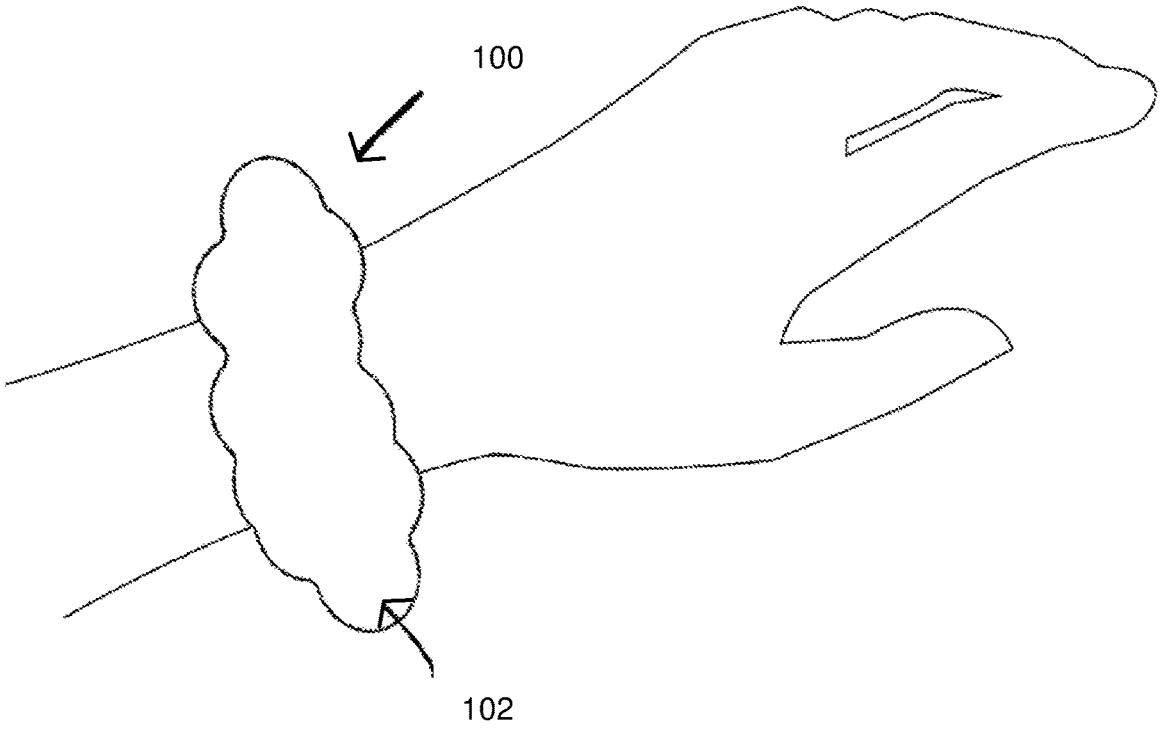
FIG. 4A is a perspective view of the device worn as a hair accessory
Figure 4B:
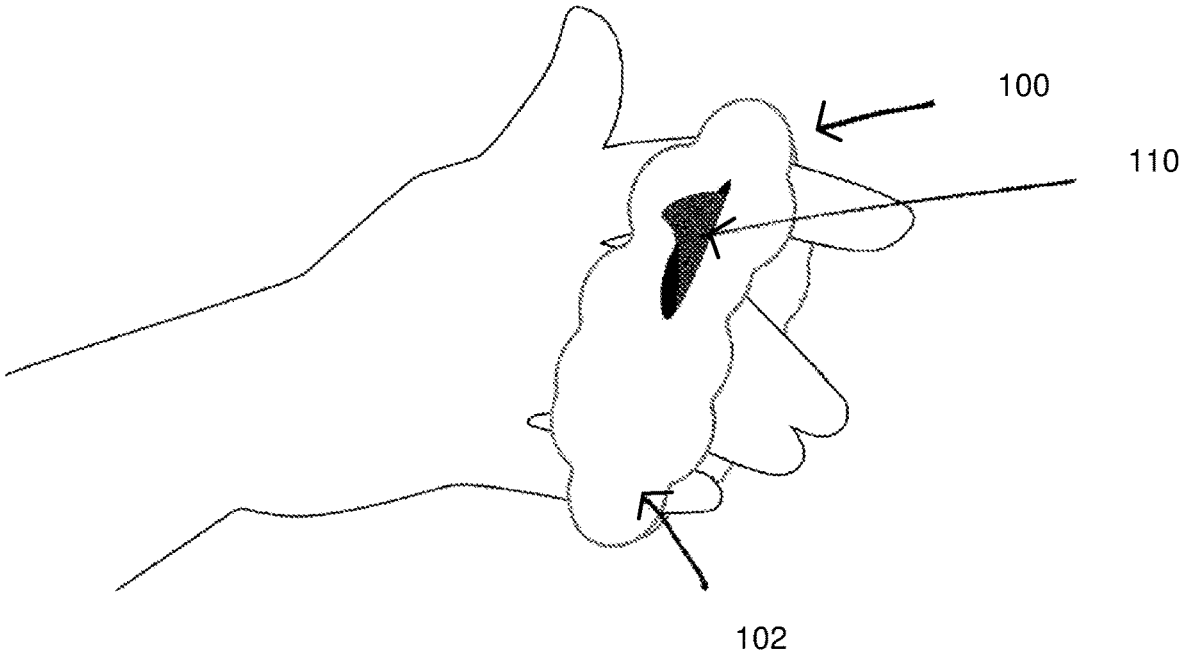
FIG. 4B is a side view showing the cover inside the device.

Turning to FIG. 4A, the device 100 is shown with the cover 110 stored in the pouch 108. In FIG. 4B, the cover 110 is visible to illustrate storage of the cover 110. As shown, discrete storage of the cover 110 allows for the device 100 to appear as a simple hair accessory 102 that can be worn by the user. The user can then wear the device 100 as a hair accessory 102 anywhere without signaling or notifying other people that the user has the device 100. Further the user can wear the hair accessory 102 without carrying an extra component such as a lid or container.

Figure 5:
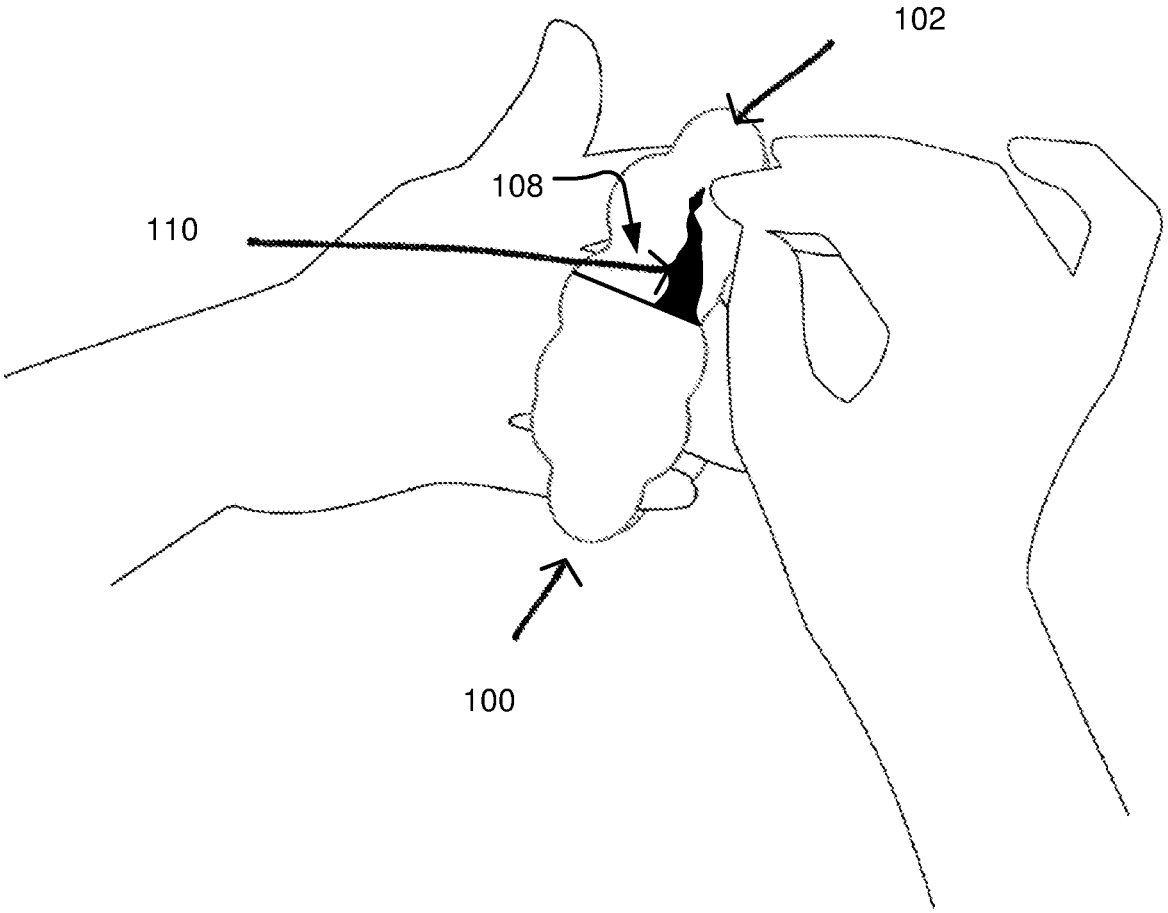
FIG. 5 is a side view showing the cover being removed from the pouch to be placed over a cup.

FIG. 5 illustrates removal of the cover 110 from the pouch 108 of the device 100. Removal and storage of the cover 110 from the pouch 108 is simple, easy to use, and quick. The user simply pulls the cover 110 from the pouch 108 for use and tucks the cover 110 into the pouch 108 for storage. Quick use and storage of the cover 110 allows for the user to use the device 100 without interruption to their general experience (e.g., during conversation).

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular implementations. Functionality can be separated or combined in blocks differently in various implementations of the disclosure or described with different terminology. These and other variations, modifications, additions, and improvements can fall within the scope of the disclosure as defined in the claims that follow.

What is claimed is:

1. A drink spiking prevention device comprising:

a hair accessory comprising:

a band forming a circle, the band being elastic, a hair accessory fabric forming a tube that encapsulates the band, and a pouch coupled to the hair accessory fabric; and a cover stored in and removable from the pouch, the cover having a cover fabric that extends to a perimeter, an aperture formed in the cover fabric, and a cord extending from the perimeter and coupled to the hair accessory, the cover covering an opening of a cup by the perimeter stretching over and conforming to a diameter of the opening, the aperture receiving an elongate tube when the cover covers the opening of the cup.

2. The device of claim 1, wherein the pouch has a length at least one-third of a length of the tube formed by the hair accessory fabric.

3. The device of claim 1, wherein the pouch has a length less than one-third of a length of the tube formed by the hair accessory fabric.

4. The device of claim 1, wherein the cover fabric is opaque.

5. The device of claim 1, wherein the cover fabric detects when a new material is added to a liquid held in the cup.

6. The device of claim 5, wherein the cover fabric displays a visual cue when the new material is detected.

7. The device of claim 1, wherein an opening of the pouch extends around the tube of the hair accessory fabric.

8. The device of claim 1, wherein an opening of the pouch extends partially around the tube of the hair accessory fabric.

9. The device of claim 1, wherein an opening of the pouch is a zippered opening.

10. A method of preventing drink spiking comprising:

removing a cover from a hair accessory, the hair accessory comprising a band forming a circle, a hair accessory fabric forming a tube that encapsulates the band, and a pouch coupled to the hair accessory fabric that receives and stores the cover, the cover having a cover fabric that extends to a perimeter, an aperture formed in the cover fabric, and a cord extending from the perimeter and coupled to the hair accessory;

stretching the perimeter and cover over an opening of a cup; and releasing the perimeter and cover, the perimeter conforming to a diameter of the opening, thereby securing the cover over the opening.

11. The method of claim 10, further comprising receiving an elongate tube by the aperture.

12. The method of claim 10, wherein the pouch has a length at least one-third of a length of the tube.

13. The method of claim 10, wherein the pouch has a length less than one-third of a length of the tube.

14. The method of claim 10, wherein the cover fabric is opaque.

15. The method of claim 10, wherein the cover fabric detects when a new material is added to a liquid held in the cup.

16. The method of claim 15, wherein the cover fabric displays a visual cue when the new material is detected.

17. The method of claim 10, wherein an opening of the pouch extends around the tube of the hair accessory fabric.

18. The method of claim 10, wherein an opening of the pouch extends partially around the tube of the hair accessory fabric.

19. The method of claim 10, wherein an opening of the pouch is a zippered opening.

20. The method of claim 10, wherein the band is elastic.

* * * * *